US008777664B2

(12) United States Patent
Gui et al.

(10) Patent No.: US 8,777,664 B2
(45) Date of Patent: Jul. 15, 2014

(54) CABLE CONNECTOR, RECEPTACLE CONNECTOR AND CONNECTOR ASSEMBLY THEREOF WITH IMPROVED CONTACT ARRANGEMENT

(75) Inventors: Yong-Nan Gui, KunShan (CN); Lin Wu, KunShan (CN); Wei-Ya Cheng, KunShan (CN)

(73) Assignee: Lanto Electronic Limited, Kunshan (CN)

( * ) Notice: Subject to any disclaimer, the term of this patent is extended or adjusted under 35 U.S.C. 154(b) by 36 days.

(21) Appl. No.: 13/550,945

(22) Filed: Jul. 17, 2012

(65) Prior Publication Data

US 2013/0045638 A1 Feb. 21, 2013

(30) Foreign Application Priority Data

Aug. 18, 2011 (CN) ..... 2011 1 0237659

(51) Int. Cl.
*H01R 25/00* (2006.01)

(52) U.S. Cl.
USPC ..... 439/607.25

(58) Field of Classification Search
USPC ..... 439/660, 607.5, 638, 607.2, 358, 658, 439/682, 607.56
See application file for complete search history.

(56) References Cited

U.S. PATENT DOCUMENTS 6,007,362 A * 12/1999 Davis et al. ..... 439/358
6,022,246 A * 2/2000 Ko ..... 439/680
6,334,793 B1 * 1/2002 Amoni et al. ..... 439/680
6,350,159 B1 * 2/2002 Wu ..... 439/680
6,364,715 B1 * 4/2002 Liu et al. ..... 439/638
6,592,392 B2 * 7/2003 Po-Heng ..... 439/358
6,776,658 B2 * 8/2004 Tang ..... 439/607.58
6,860,765 B1 * 3/2005 Spink, Jr. ..... 439/680
7,029,290 B2 * 4/2006 Wu ..... 439/76.1
7,128,595 B2 * 10/2006 Boutros ..... 439/358
7,614,920 B1 * 11/2009 Yi ..... 439/682
7,758,388 B2 * 7/2010 Xu et al. ..... 439/651
7,850,477 B2 * 12/2010 Koyama et al. ..... 439/358
8,007,320 B1 * 8/2011 Zhang et al. ..... 439/638
8,011,959 B1 * 9/2011 Tsai et al. ..... 439/607.25
8,011,960 B2 * 9/2011 Xiao et al. ..... 439/607.56
8,052,438 B1 * 11/2011 Hung ..... 439/131
8,118,497 B2 * 2/2012 Yi ..... 385/93
8,128,422 B2 * 3/2012 Mellott et al. ..... 439/180
8,162,694 B2 * 4/2012 Hisada et al. ..... 439/607.23
8,172,585 B2 * 5/2012 Chiu et al. ..... 439/108

(Continued)

FOREIGN PATENT DOCUMENTS

CN 202150590 U 2/2012

*Primary Examiner* — Alexander Gilman
(74) *Attorney, Agent, or Firm* — Seed IP Law Group PLLC

(57) ABSTRACT

A connector assembly includes a cable connector and a receptacle connector. The receptacle connector includes a receptacle housing defining a receiving slot and a number of contacts including multiple first contacts and multiple second contacts. The second contacts include a number of differential signal contacts and ground contacts among which the differential signal contacts are paired and the ground contacts are located at opposite lateral sides of each paired differential signal contacts. The first contacts are ordinally arranged as GGVV, or VGVG, or VVGG, or GVGV, or GVVG, or VGGV, or VSSG, or GSSV. The second contacts are compatible to USB 3.0 protocol for high-speed signal transmission. As a result, it is easy to control the impedance of the whole transmission system so as to decrease signal attenuation and signal reflection.

12 Claims, 25 Drawing Sheets

(56) References Cited

U.S. PATENT DOCUMENTS

| | | | | |
|---|---|---|---|---|
| 8,198,563 | B2 * | 6/2012 | Tsai | 218/140 |
| 8,253,598 | B2 * | 8/2012 | Ho | 341/22 |
| 8,328,579 | B2 * | 12/2012 | Sasaki et al. | 439/607.25 |
| 8,348,685 | B2 * | 1/2013 | Liao et al. | 439/131 |
| 8,348,704 | B2 * | 1/2013 | Sloey et al. | 439/690 |
| 8,485,851 | B2 * | 7/2013 | Kondo et al. | 439/660 |
| 8,500,494 | B2 * | 8/2013 | Wu | 439/660 |
| 8,550,828 | B2 * | 10/2013 | Liao et al. | 439/131 |
| 2005/0064757 | A1 * | 3/2005 | Kathan et al. | 439/357 |
| 2005/0272303 | A1 * | 12/2005 | Wu | 439/499 |
| 2006/0216991 | A1 * | 9/2006 | Boutros | 439/607 |
| 2010/0062653 | A1 * | 3/2010 | Mao et al. | 439/660 |
| 2010/0151720 | A1 * | 6/2010 | Lin | 439/358 |
| 2011/0195605 | A1 * | 8/2011 | Zhang et al. | 439/638 |
| 2012/0178279 | A1 * | 7/2012 | Kim et al. | 439/357 |

* cited by examiner

CABLE CONNECTOR, RECEPTACLE CONNECTOR AND CONNECTOR ASSEMBLY THEREOF WITH IMPROVED CONTACT ARRANGEMENT

BACKGROUND

1. Technical Field

The present disclosure relates to a cable connector, a receptacle connector and a connector assembly thereof, and more particularly to a high-speed cable connector, a high-speed receptacle connector and a connector assembly thereof with improved paddle PCB as a tongue plate for impedance matching and cross-talk reduction.

2. Description of the Related Art

Universal Serial Bus (USB) has been widely used in electronic products due to its stable transmission speed and high performance. With the development of the USB port protocol, it will surely transit to USB 3.0 version after USB 1.0 version and USB 2.0 version. Comparing with the USB 2.0 port, the USB 3.0 port is provided with transmission speed ten times faster. Presently, it is a flat connector port developed by Intel which can support the USB 3.0 protocol. The flat connector port includes a board connector for mounting on a mother board and a cable connector for mating with the board connector. The cable connector includes multiple contacts and cables for electrically connecting the contacts. However, it is difficult for impedance matching among the board connector, the mother board and the cables according to the conventional connector ports, as a result that the high-frequency performance of the conventional connector ports is poor and signal distortion may so much as occur in transmission.

Hence, an improved cable connector, an improved receptacle connector and a connector assembly thereof with robust high-frequency performance for high speed signal transmission are desired.

BRIEF SUMMARY

The present disclosure relates to a connector assembly including a cable connector and a receptacle connector for mating with each other. In an embodiment, the receptacle connector includes a receptacle housing and a plurality of contacts received in the receptacle housing. The receptacle housing defines a mating face and a receiving slot recessed from the mating face. Each contact includes an elastic contacting portion sidewardly extending into the receiving slot. The contacts include a plurality of first contacts and a plurality of second contacts which are compatible to USB 3.0 protocol. The second contacts include a plurality of differential signal contacts and ground contacts among which the differential signal contacts are paired and the ground contacts are located at opposite lateral sides of each paired differential signal contacts. The first contacts are ordinally arranged as GGVV, or VGVG, or VVGG, or GVGV, or GVVG, or VGGV, or VSSG, or GSSV.

In an embodiment, the cable connector includes a plug housing defining a mating surface and a paddle PCB fixed on the plug housing. The paddle PCB includes a cantilevered tongue plate extending forwardly beyond the mating surface. The tongue plate is provided with a plurality of conductive pads formed on at least one side surface thereof. The tongue plate includes a first tongue and a second tongue adjacent to the first tongue. The conductive pads include a plurality of first pads formed on the first tongue and a plurality of second pads formed on the second tongue. The second pads are compatible to USB 3.0 protocol and include a plurality of differential signal pads and ground pads among which the differential signal pads are paired and the ground pads are located at opposite lateral sides of each paired differential signal pads. The first pads are ordinally arranged as GGVV, or VGVG, or VVGG, or GVGV, or GVVG, or VGGV, or VSSG, or GSSV.

When the cable connector and the receptacle connector are mateable with each other, the tongue plate of the cable connector is received in the receiving slot of the receptacle connector, and the elastic contacting portions of the first and the second contacts engage with corresponding first and second pads for signal transmission. Since the tongue plate is formed by a PCB, it is easy to control the impedance of the whole transmission system via the cable connector so as to decrease signal attenuation and signal reflection.

The foregoing has outlined rather broadly the features and technical advantages of at least one embodiment in order that the detailed description that follows may be better understood. Additional features and advantages of embodiments will be described hereinafter which form the subject of the claims.

BRIEF DESCRIPTION OF THE SEVERAL VIEWS OF THE DRAWINGS

For a more complete understanding of the present disclosure, and the advantages of embodiments thereof, reference is now made to the following descriptions taken in conjunction with the accompanying drawings, in which.

DETAILED DESCRIPTION

Figure 20:
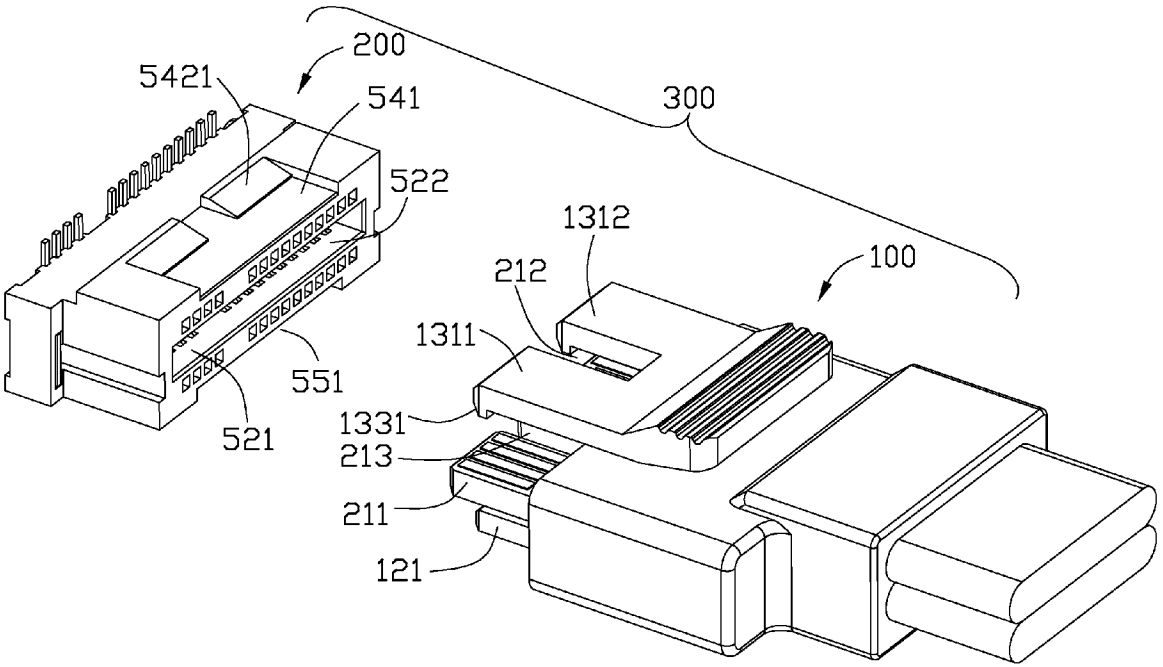
FIG. 20 is a perspective view of a connector assembly showing the cable connector separate from the receptacle connector.
Figure 21:
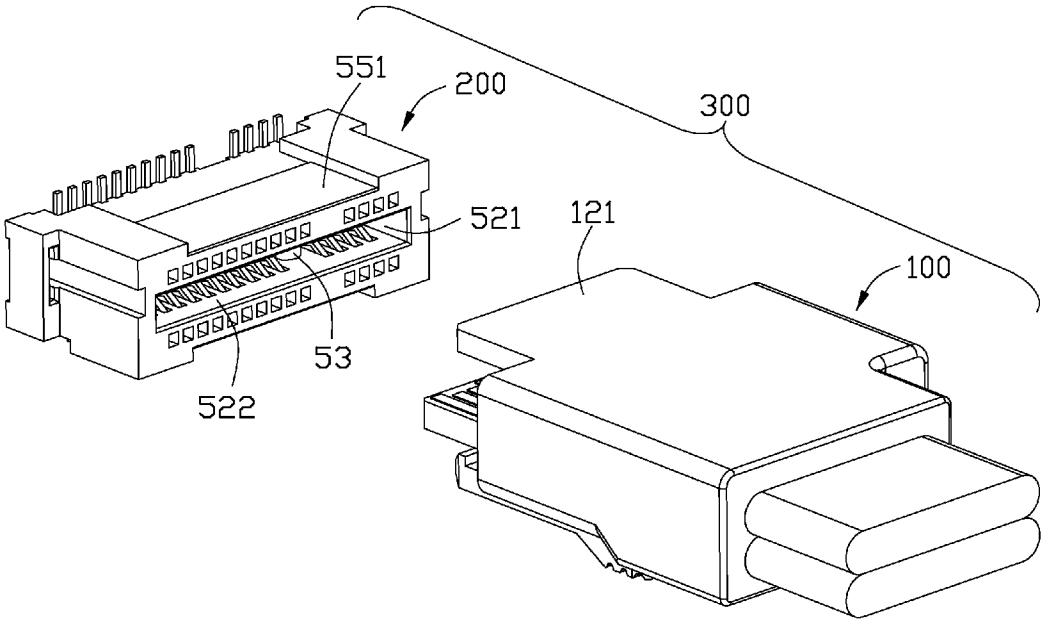
FIG. 21 is another perspective view of the connector assembly as shown in FIG. 20.
Figure 22:
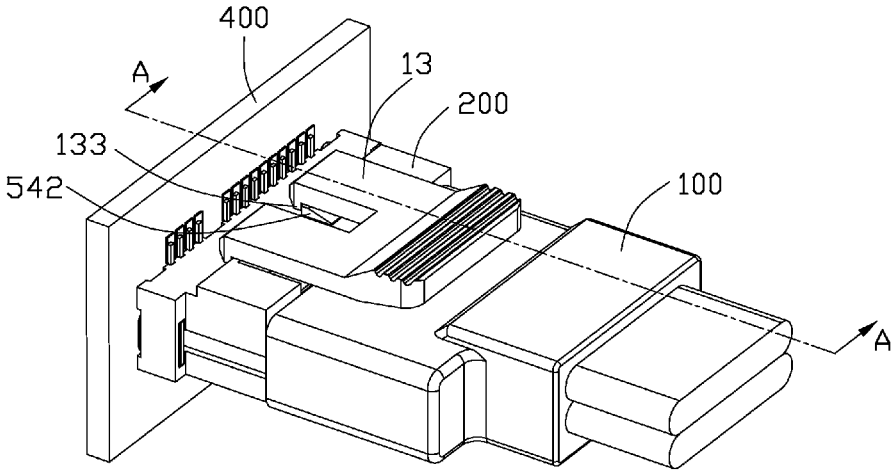
FIG. 22 is a perspective view of the connector assembly with the cable connector inserted in the receptacle connector.
Figure 23:
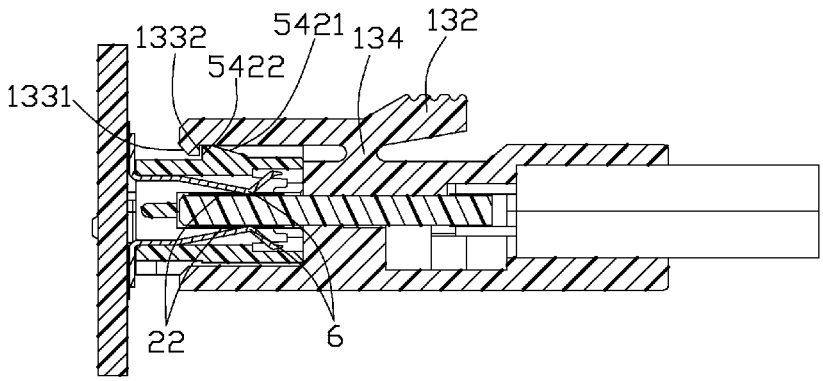
FIG. 23 is a cross-sectional view of the connector assembly taken along line A-A in FIG. 22.

Reference will now be made to the drawing figures to describe some preferred embodiments in detail. FIGS. 20 to 22 illustrate a connector assembly 300 including a receptacle connector 200 for mounting to a circuit board 400 and a cable connector 100 for mating with the receptacle connector 200. According to the illustrated embodiments, both the cable connector 100 and the receptacle connector 200 are compatible to USB 3.0 protocol.

Figure 1:
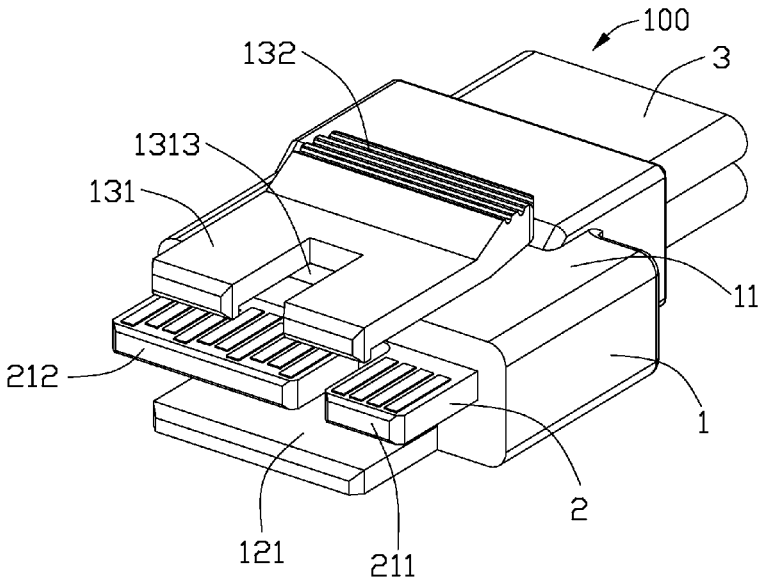
FIG. 1 is a perspective view of a cable connector in accordance with an illustrated embodiment.
Figure 2:
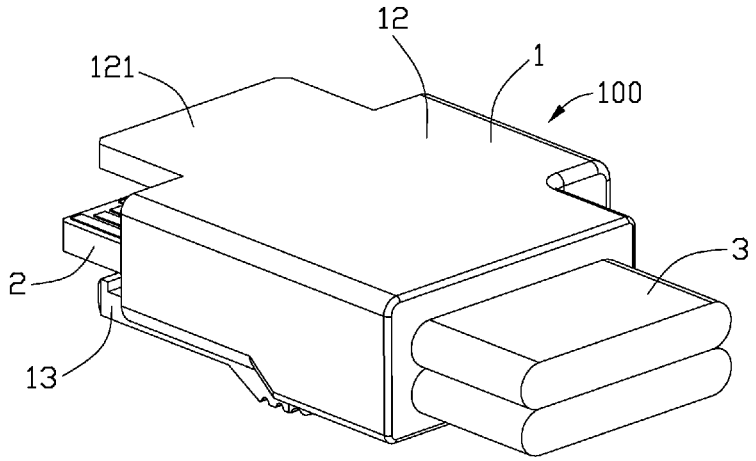
FIG. 2 is another perspective view of the cable connector as shown in FIG. 1, taken from a different aspect.

Referring to FIGS. 1 and 2, the cable connector 100 includes an insulative plug housing 1, a paddle printed circuit board (PCB) 2 retained in the plug housing 1 and a pair of cable assemblies 3 each including a plurality of cables (not labeled) for electrically connecting with the paddle PCB 2.

Referring to FIGS. 3 to 6, the plug housing 1 includes a mating surface 101 and a mounting surface 102 opposite to the mating surface 101. From a structure view, the plug housing 1 includes a first exterior wall 11, a second exterior wall 12 opposite to the first exterior wall 11 and a locking mechanism 13 on the first exterior wall 11. According to the preferred embodiment, the first and the second exterior walls 11, 12 are top and bottom walls of the plug housing 1, respectively. The second exterior wall 12 includes a flat position block 121 cantileveredly extending forwardly beyond the mating surface 101. The position block 121 is rectangular and helps guiding insertion of and supporting the cable connector 100 so as to avoid the cable connector 100 offsetting from the receptacle connector 200 during insertion. The locking mechanism 13 includes a cantilevered locking arm 131 and a pressing portion 132 connecting and protruding upwardly from the locking arm 131. The locking arm 13 can be swingable with respect to the first exterior wall 11 via downwardly pressing the pressing portion 132. The locking arm 131 includes a hook 133 towards the paddle PCB 2. The hook 133 includes a slant surface 1331 and a vertical surface 1332 behind the slant surface 1331. The plug housing 1 is overmolded to enclose the paddle PCB 2 and the cable assemblies 3 so as to prevent the paddle PCB 2 from disconnecting with the cable assemblies 3. A first gap 14 is formed between the locking arm 131 and the first exterior wall 11. A second gap 15 is formed between the pressing portion 132 and the first exterior wall 11 and the second gap 15 is greater than the first gap 14 for reasonable deformation of the pressing portion 132.

Figure 3:
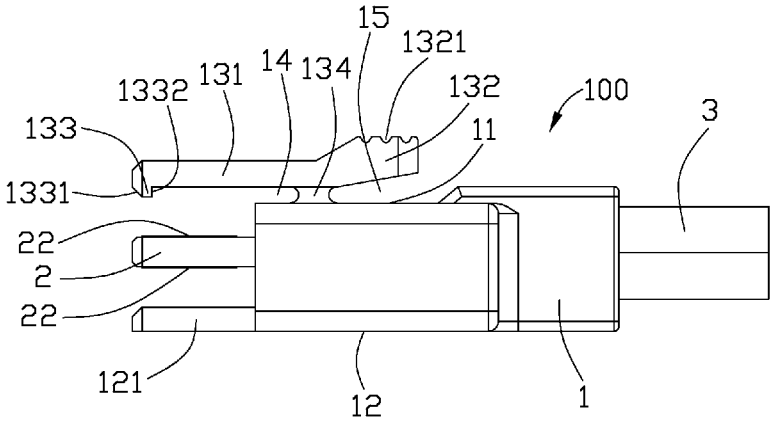
FIG. 3 is a side view of the cable connector as shown in FIG. 1.

Referring to FIG. 3, the locking mechanism 13 includes a fixed portion 134 between the hook 133 and the pressing portion 132 along a front-to-back direction. The fixed portion 134 is fastened to the first exterior wall 11 so that the locking arm 131 is swingable around the fixed portion 134 with respect to the first exterior wall 11. According to the illustrated embodiment, the fixed portion 134 is integrally formed with the first exterior wall 11 for cost saving. The pressing portion 132 defines a plurality of grooves 1321 in order to improve friction with fingers.

Figure 4:
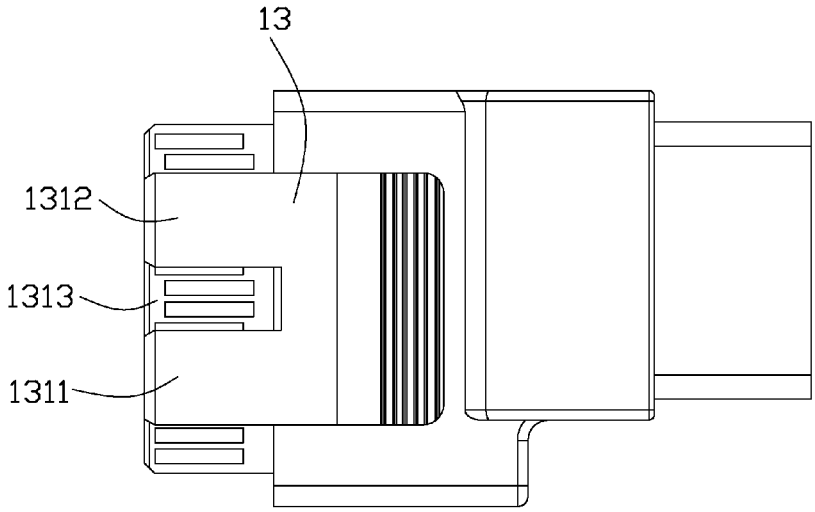
FIG. 4 is a top view of the cable connector as shown in FIG. 1.
Figure 5:
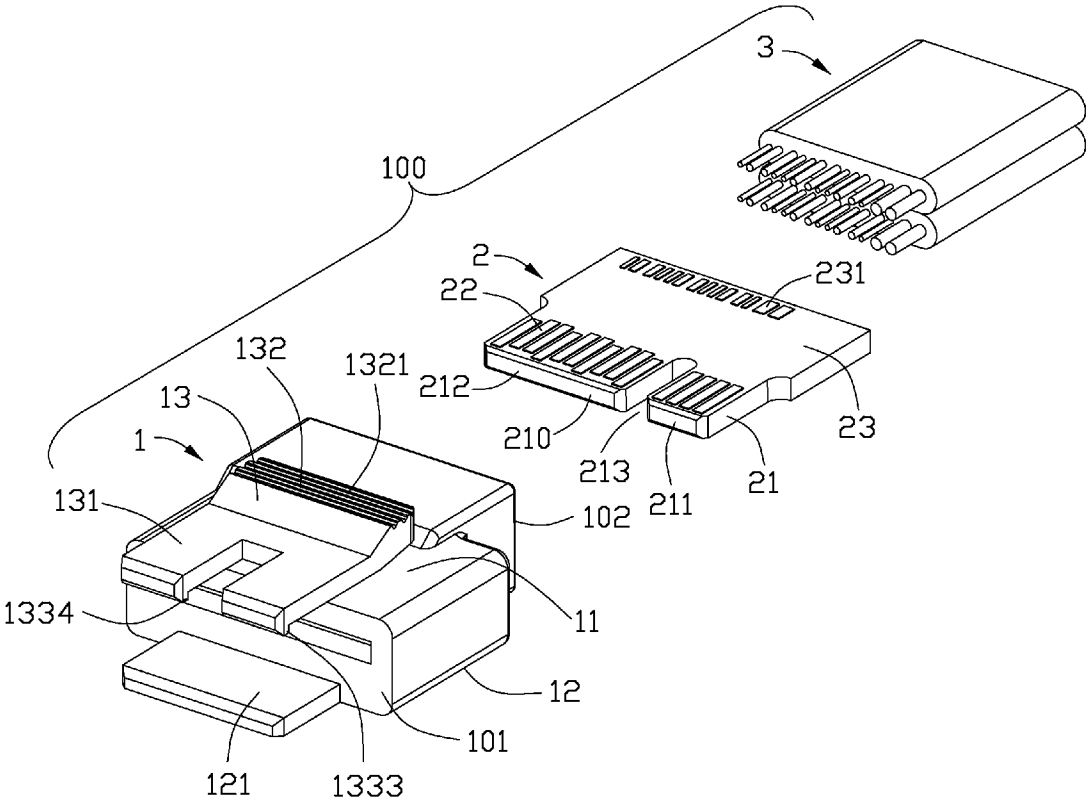
FIG. 5 is an exploded view of the cable connector.
Figure 6:
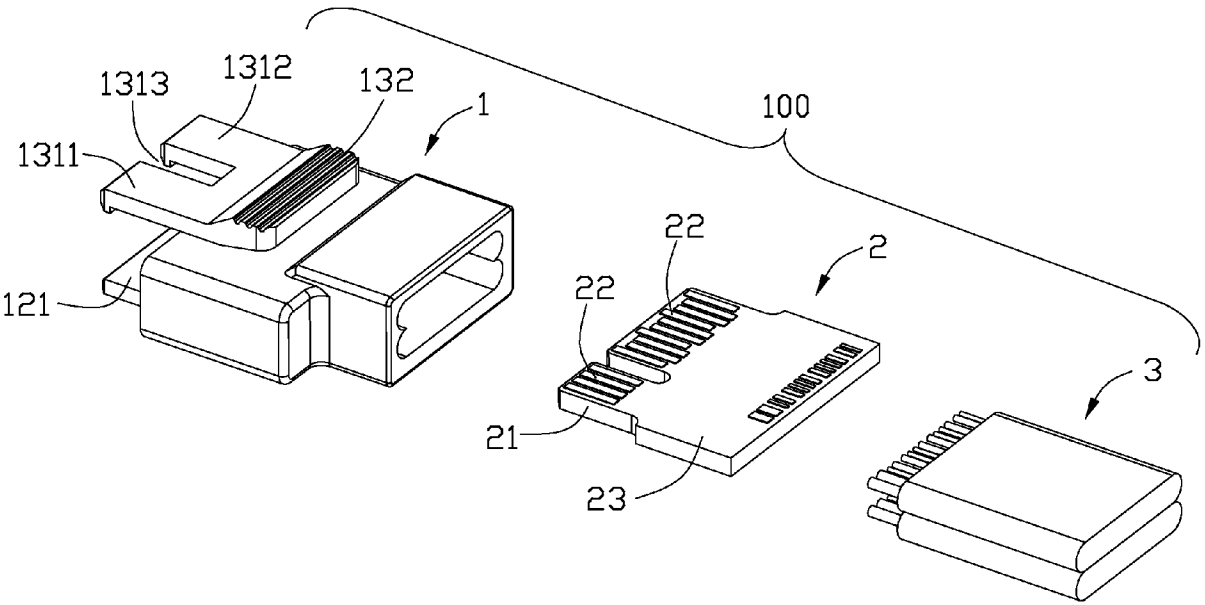
FIG. 6 is another exploded view of the cable connector as shown in FIG. 5.

Referring to FIGS. 3 to 5, the locking arm 131 includes a first arm 1311, a second arm 1312 and a slot 1313 separating the first and the second arms 1311, 1312. The hook 133 includes a first hook 1333 formed on a distal end of the first arm 1311 and a second hook 1334 formed on a distal end of the second arm 1312. The separate first and the second arms 1311, 1312 can help to improve elasticity of each arm 1311, 1312 so as to easily assemble the first and the second arms 1311, 1312 to the receptacle connector 200, or remove the first and the second arms 1311, 1312 from the receptacle connector 200.

The paddle PCB 2 includes a cantilevered tongue plate 21 forwardly extending beyond the mating surface 101, a plurality of conductive pads 22 formed on both opposite sides of the tongue plate 21, and a cable-mounting portion 23 opposite to the tongue plate 21. The tongue plate 21 is located between the locking arm 131 and the position block 121. Conductive pads 22 are also known as golden fingers to those of ordinary skill in the art. The tongue plate 21 includes a first tongue 211, a second tongue 212 and a cutout 213 separating the first and the second tongues 211, 212. The cutout 213 extends through a front end of the tongue plate 21. The first and the second tongues 211, 212 have different widths so that the paddle PCB 2 can be prevented from mistakenly inserting into the receptacle connector 200. According to the illustrated embodiment, the second tongue 212 is wider than the first tongue 211. Since the tongue plate 21 is formed by a PCB (Printed Circuit Board), it is easy to control impedance of the cable connector 100 and decrease signal attenuation and signal reflection.

Figure 7:
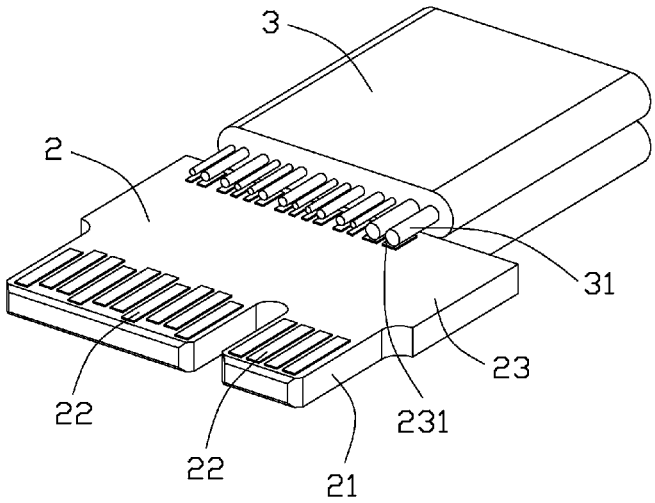
FIG. 7 is a partly perspective view of the cable connector showing cables connecting with a paddle PCB.
Figure 8:
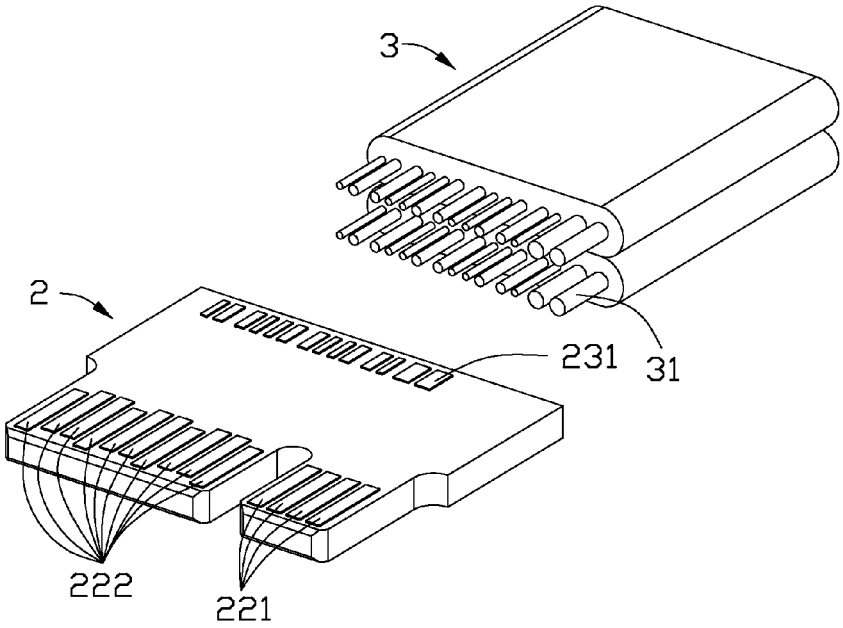
FIG. 8 is a partly exploded view of the cable connector showing cables separate from the paddle PCB.
Figure 9:
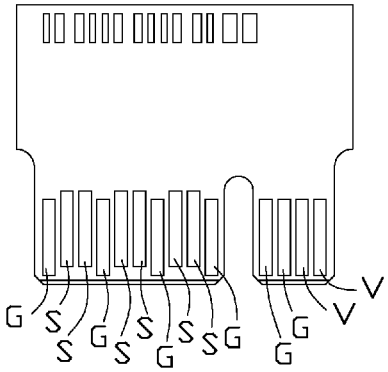
FIG. 9 is a top view of the paddle PCB as shown in FIG. 8, according to a first embodiment.
Figure 10:
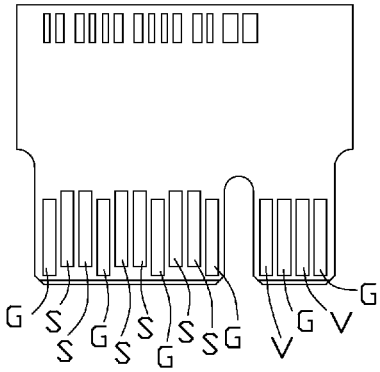
FIG. 10 is another top view of the paddle PCB as shown in FIG. 8, according to a second embodiment.
Figure 11:
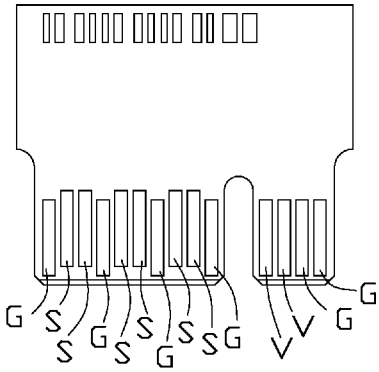
FIG. 11 is another top view of the paddle PCB as shown in FIG. 8, according to a third embodiment.
Figure 12:
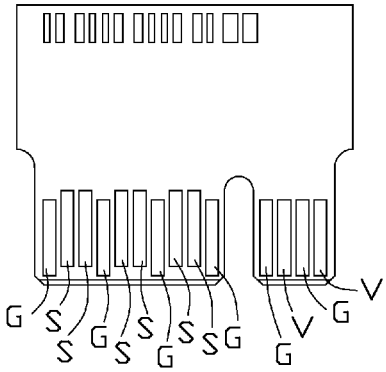
FIG. 12 is another top view of the paddle PCB as shown in FIG. 8, according to a fourth embodiment.
Figure 13:
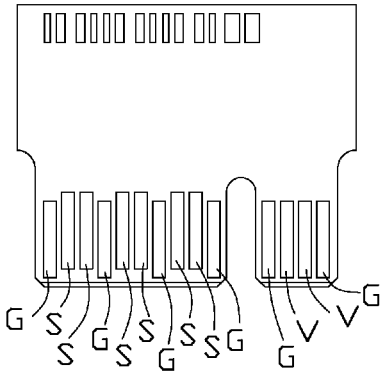
FIG. 13 is another top view of the paddle PCB as shown in FIG. 8, according to a fifth embodiment.
Figure 14:
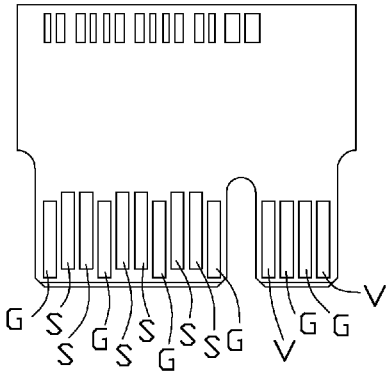
FIG. 14 is another top view of the paddle PCB as shown in FIG. 8, according to a sixth embodiment.
Figure 15:
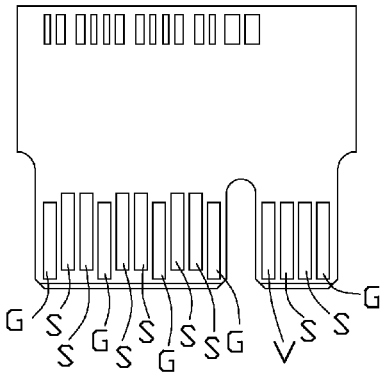
FIG. 15 is another top view of the paddle PCB as shown in FIG. 8, according to a seventh embodiment.
Figure 16:
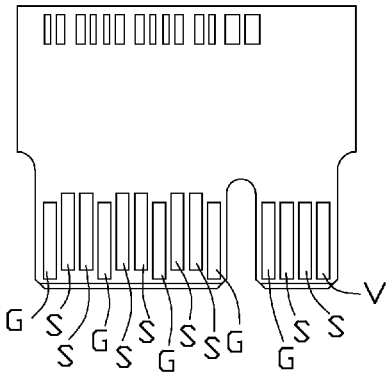
FIG. 16 is another top view of the paddle PCB as shown in FIG. 8, according to an eighth embodiment.

Referring to FIGS. 7 and 8, the conductive pads 22 include a plurality of first pads 221 set on the first tongue 211 and a plurality of second pads 222 set one the second tongue 222. According to the illustrated embodiment, both upper and lower surfaces of the first tongue 211 are formed with the first pads 221, and both upper and lower surfaces of the second tongue 222 are formed with the second pads 222. Since the conductive pads 22 formed on the upper and the lower surfaces of the tongue plate 21 are of the same arrangement, only the conductive pads 22 of the same side of the tongue plate 21 are described for simplicity. Referring to FIG. 9, the second pads 222 are arranged as GSSGSSGSSG in turn from left to right, among which "G" represents grounding and "S" represents signal. The two "SS" located between adjacent "G" represents a differential signal pair including a positive signal and a negative signal. That is to say, the second pads 222 include a plurality of differential signal pads and ground pads among which the differential signal pads are paired and the ground pads are located at opposite lateral sides of each paired differential signal pads. The second pads 222 are compatible to USB 3.0 protocol for high speed signal transmission. The second pads 222 representing "G" are adapted for decreasing cross-talk between paired differential signal pads. Referring to FIGS. 9 to 16, the first pads 221 are ordinally arranged as GGVV, or VGVG, or VVGG, or GVGV, or GVVG, or VGGV, or VSSG, or GSSV, among which "G" represents grounding, "S" represents signal and "V" represents power.

The cable-mounting portion 23 includes a plurality of soldering pads 231 set on upper and lower surfaces thereof. The soldering pads 231 are adapted for electrically connecting with the first and the second pads 221, 222. Each cable includes a conductive layer 31 for engaging with the conductive pads 22. Referring to FIG. 7, the conductive layers 31 are soldered with the soldering pads 231 so as to establish connection between the cables and the conductive pads 22. The cables can be formed by flat cables for easily achieving impedance matching and controlling high-frequency performance. According to the illustrated embodiment, two groups of cable assemblies 3 are disclosed so that a single port can transmit two groups of USB 3.0 signals, simultaneously. The definition of each cable assembly 3 is the same as the arrangement of the first pads 221 and the second pads 222 so that detailed description thereof is omitted herein.

Figure 17:
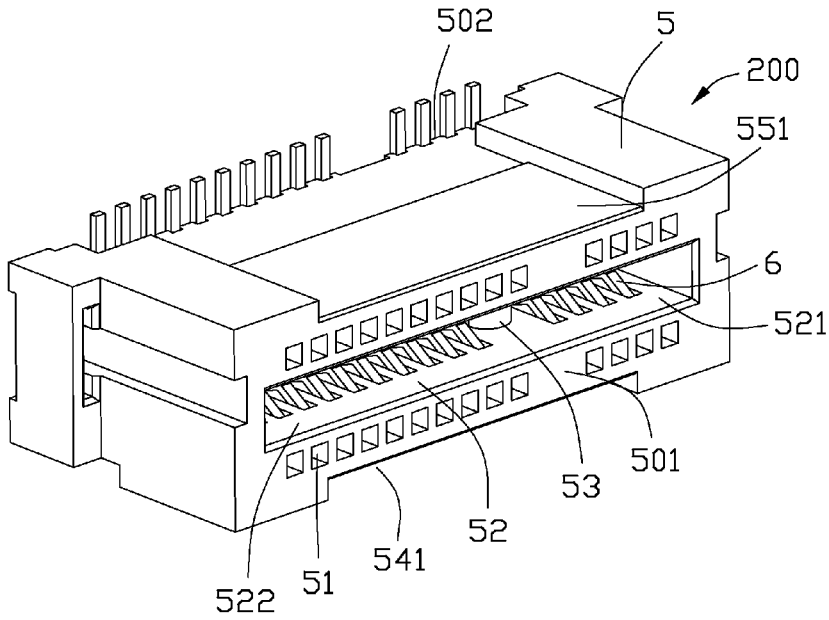
FIG. 17 is a perspective view of a receptacle connector in accordance with an illustrated embodiment.
Figure 18:
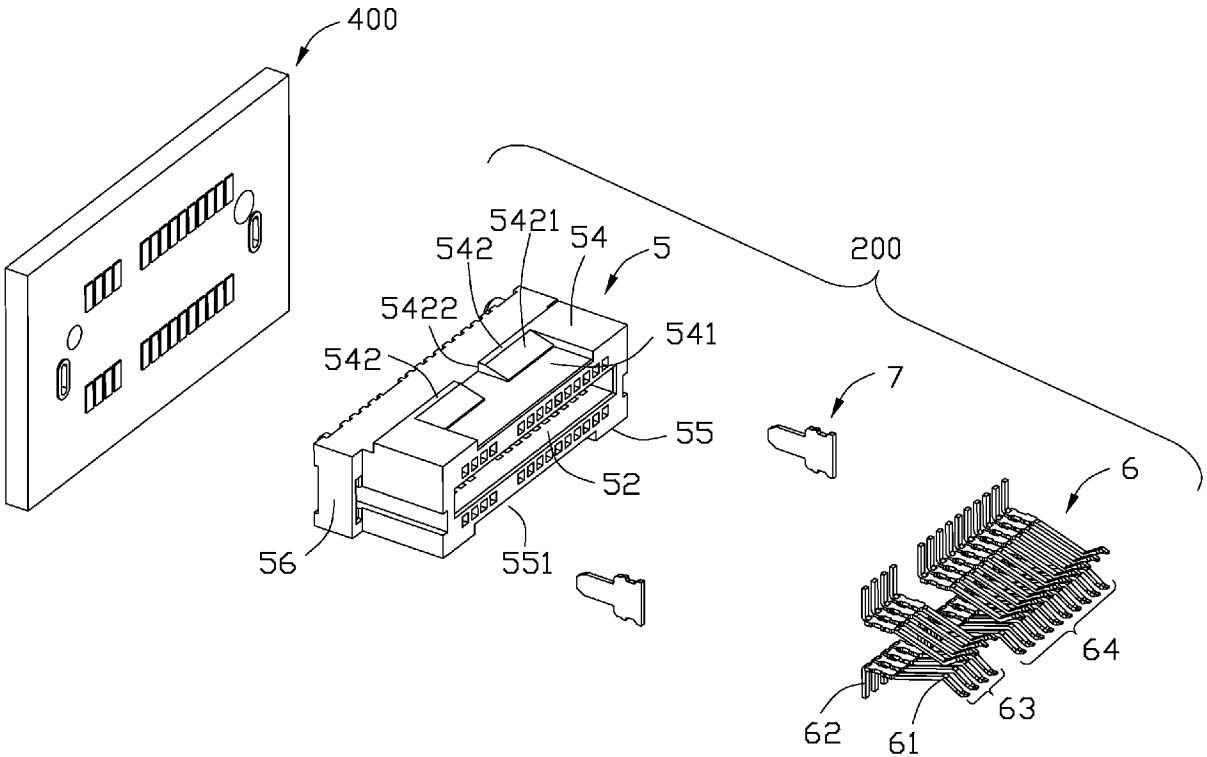
FIG. 18 is an exploded view of the receptacle connector as shown in FIG. 17.
Figure 19:
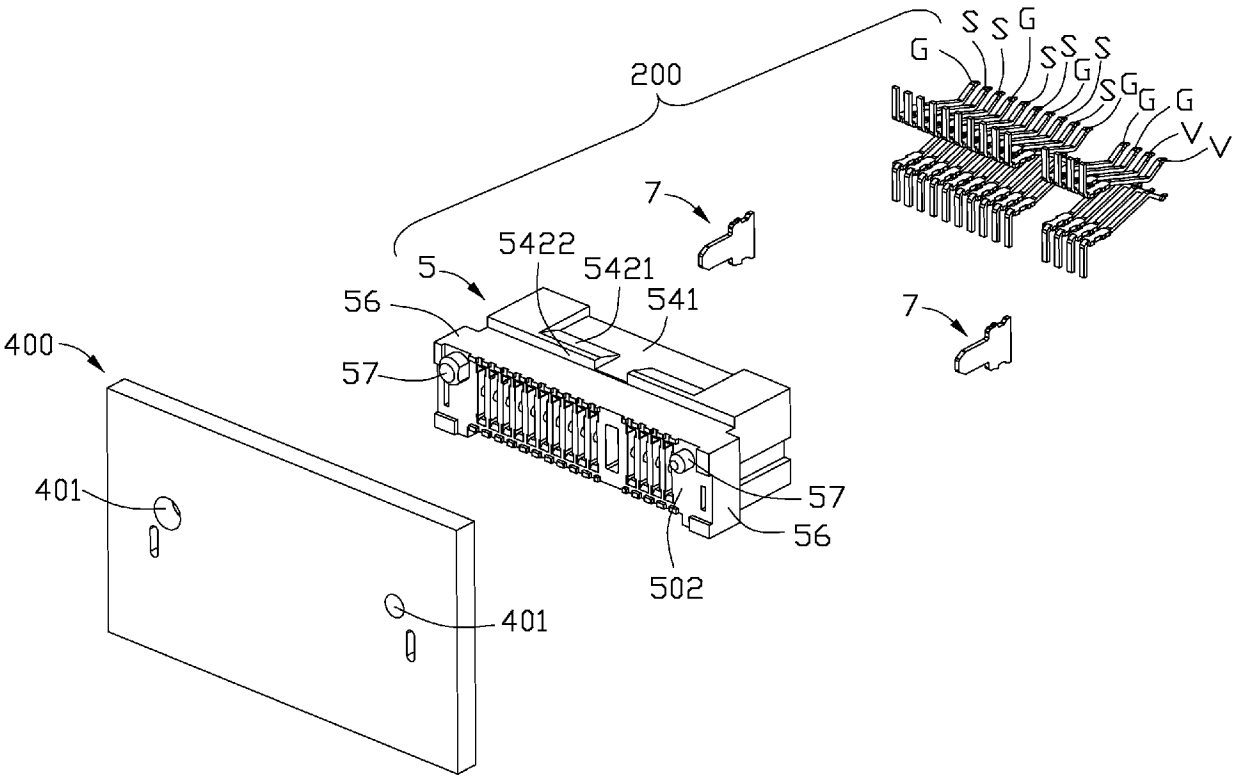
FIG. 19 is another exploded view of the receptacle connector as shown in FIG. 17.

Referring to FIG. 17, the receptacle connector 200 includes an insulative receptacle housing 5 and a plurality of contacts 6 received in the receptacle housing 5. The receptacle housing 5 includes a mating face 501, a mounting face 502 opposite to the mating face 501, a plurality of passageways 51 extending through the mating face 501 and the mounting face 502, and a receiving slot 52 recessed inwardly from the mating face 501. The receptacle housing 5 further includes a rib 53 located in the receiving slot 52 to divide the receiving slot 52 into a first slot 521 and a second slot 522. The first and the second slots 521, 522 have different widths so that the cable connector 100 can be prevented from being reversely/incorrectly inserted into the receptacle connector 200. The rib 53 is formed inside the mating face 501 in order to decrease the length of the cutout along the front-to-back direction. Referring to FIGS. 18 and 19, the receptacle housing 5 includes a top wall 54, a bottom wall 55 and a pair of sidewardly extending blocks 56. The receiving slot 52 is located between the top wall 54 and the bottom wall 55. The top wall 54 includes a recess 541 extending through the mating face 501 and a protrusion 542 at the rear of the recess 541. The protrusion 542 includes a slant guiding surface 5421 exposed to the recess 541 for guiding insertion of the locking arm 131 and a rear vertical surface 5422 for engaging with the hook 133. The bottom wall 55 further includes a rectangular position slot 551 extending through the mating face 501 for receiving the position block 121 of the cable connector 100.

The contacts 6 are received in the passageways 51 and each contact 6 includes an elastic contacting portion 61 sidewardly extending into the receiving slot 52 and a mounting portion 62 extending beyond the receptacle housing 5. The contacts 6 include a plurality of first contacts 63 extending into the first slot 521 and a plurality of second contacts 64 extending into the second slot 522. According to the illustrated embodiment, both sides of the first slot 521 are set with the first contacts 63 and both sides of the second slot 522 are set with the second contacts 64.

Since the arrangement of the contacts 6 of each side is the same, only the contacts 6 located at the same side of the first and the second slots 521, 522 are detailedly described hereinafter. Referring to FIG. 19, in accordance with the arrangement of the second pads 222, the second contacts 64 are arranged as GSSGSSGSSG in turn from left to right, among which "G" represents grounding and "S" represents signal. The two "SS" located between adjacent "G" represents a differential signal pair including a positive signal and a negative signal. That is to say, the second contacts 64 includes a plurality of differential signal contacts and ground contacts among which the differential signal contacts are paired and the ground contacts are located at opposite lateral sides of each paired differential signal contacts. The second contacts 64 are compatible to USB 3.0 protocol for high speed signal transmission. The second contacts 64 representing "G" are adapted for decreasing cross-talk between paired differential signal contacts. In accordance with the arrangement of the first pads 221, the first contacts 63 are ordinally arranged as GGVV, or VGVG, or VVGG, or GVGV, or GVVG, or VGGV, or VSSG, or GSSV, among which "G" represents grounding, "S" represents signal and "V" represents power.

Referring to FIG. 19, the receptacle housing 5 includes a pair of mounting posts 57 protruding from the mounting face 502 for being inserted into mounting holes 401 of the circuit board 400. Each mounting portion 62 extends beyond the mounting face 502 for being soldered to the circuit board 400. According to the illustrated embodiment, the mounting portions 62 of the contacts 6 are soldered to the circuit board 400 via Surface Mounted Technology (SMT). However, in an alternative embodiment, e.g., similar to FIG. 31, the mounting portions 62 of the contacts 6 can be soldered to the circuit board 400 via Through Hole (TH) technology. The receptacle connector 200 includes a pair of claws 7 fixed to the extending blocks 56. The claws 7 extend beyond the mounting face 502 of the receptacle housing 5 for being mounted to the circuit board 400.

Referring to FIGS. 20 to 23, when the cable connector 100 is inserted into the receptacle connector 200, the first tongue 211 is received into the first slot 521, the second tongue is received into the second slot 522, and the rib 53 is received in the cutout 213. Simultaneously, the position block 121 is guided to be received in the rectangular position slot 551 for supporting. The first and the second arms 1311, 1312 are guided by the recess 541. During such insertion, the slant surfaces 1331 of the first and the second hooks 1333, 1334 engages with the slant guiding surface 5421 so that the first and the second arms 1311, 1312 pivot upwardly. Ultimately, the first and the second hooks 1333, 1334 get over the slant guiding surface 5421 and the first and the second arms 1311, 1312 release their elasticity to make the first and the second hooks 1333, 1334 lock with the rear vertical surface 5422. Under this condition, the cable connector 100 and the receptacle connector 200 are stably locked with each other with the contacts 6 mating with the conductive pads 22 for signal transmission.

When the plug connector 100 is needed to be separated from the receptacle connector 200, an external forced is applied to press downwardly the pressing portion 132 to drive the first and the second arms 1311, 1312 upwardly pivot around the fixed portion 134. Ultimately, the vertical surface 1332 of the first and the second hooks 1333, 1334 disengage with the rear vertical surface 5422 along a vertical direction, so that the plug connector 100 can be separated from the receptacle connector 200 if a pulling force along the front-to-back direction is applied.

FIGS. 24 to 30 further disclose another connector assembly 300' in accordance with another illustrated embodiment. The connector assembly 300' is compatible to USB 3.0 protocol and includes a receptacle connector 200' for mounting to a circuit board and a cable connector 100' for mating with the receptacle connector 200'. It is mentioned that the same numeral of the connector assemblies 300, 300' in the two embodiments refer to the same component. The receptacle connector 200' and the cable connector 100' are similar to the receptacle connector 200 and the cable connector 100, respectively, except the latch structures.

Figure 24:
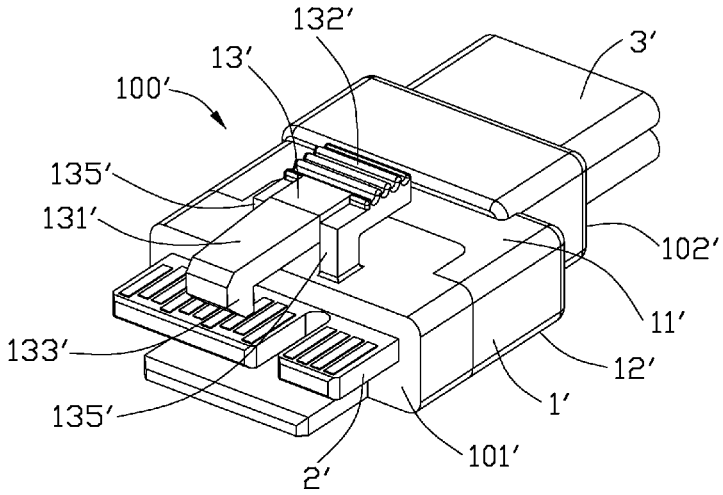
FIG. 24 is a perspective view of a cable connector in accordance with another illustrated embodiment.
Figure 25:
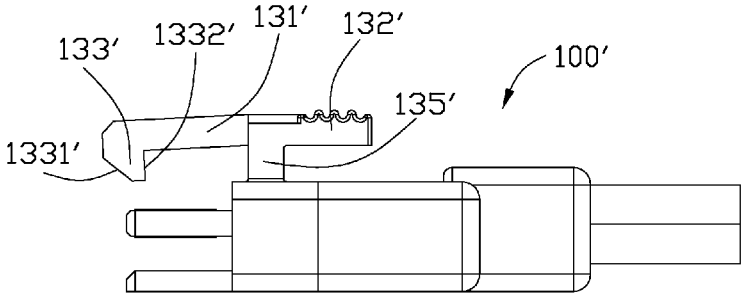
FIG. 25 is a side view of the cable connector as shown in FIG. 24.
Figure 26:
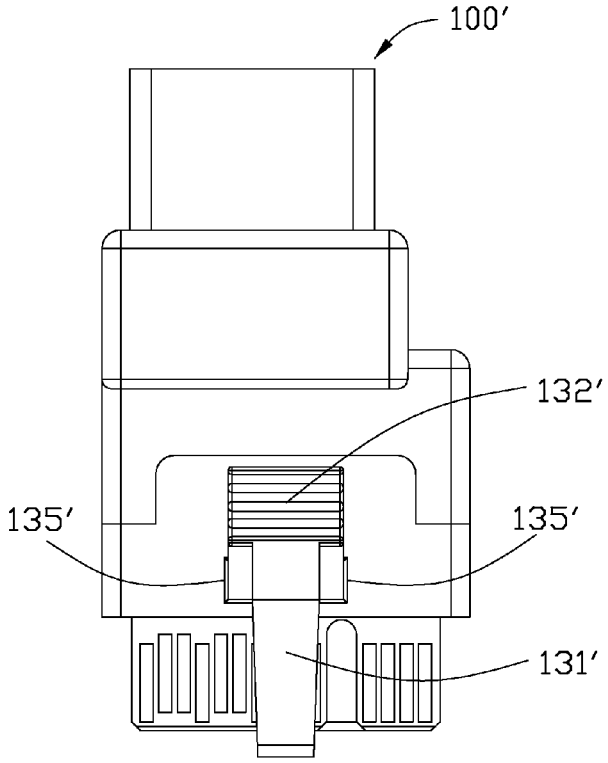
FIG. 26 is a top view of the cable connector as shown in FIG. 24.

Referring to FIGS. 24 to 26, the cable connector 100' is compatible to USB 3.0 protocol and includes an insulative plug housing 1', a paddle PCB 2' retained in the plug housing 1' and a plurality of cables 3' for electrically connecting with the paddle PCB 2'.

The plug housing 1' is made of plastic and includes a mating surface 101' and a mounting surface 102' opposite to the mating surface 101'. From a structure view, the plug housing 1' includes a first exterior wall 11', a second exterior wall 12' opposite to the first exterior wall 11' and a locking mechanism 13' on the first exterior wall 11'. According to the illustrated embodiment, the first and the second exterior walls 11', 12' are top and bottom walls of the plug housing 1', respectively. The locking mechanism 13' includes a pair of supporting portions 135' fixed on the first exterior wall 11', a pressing portion 132' connecting the supporting portions 135' and extending backwardly, and a cantilevered locking arm 131' connecting the pressing portion 132'. Each supporting portion 135' extends along a vertical direction and the pressing portion 132' extends along a horizontal direction perpendicular to the vertical direction. The locking arm 13' can be driven to pivot with respect to the first exterior wall 11' around the supporting portions 135' via downwardly pressing the pressing portion 132'. The locking arm 131' extends forwardly beyond the mating surface 101' and includes a hook 133' towards the paddle PCB 2'. The hook 133' includes a slant surface 1331' and a vertical surface 1332' behind the slant surface 1331'. With the supporting portions 135' extending a determined height along the vertical direction, a reasonable space is provided for deformation of the locking arm 131' and the pressing portion 132'. Besides, with the pair of supporting portions 135', double fulcrums can be realized so as to reinforce the locking arm 131' and increase the service life of the locking arm 131'. The locking arm 131' is situated between and protected by the pair of supporting portions 135'. According to the illustrated embodiment, the supporting portions 135' are integrally formed on the first exterior wall 11' for saving assembling costs. However, in other embodiments, the supporting portions 135' can be assembled to fix on the first exterior wall 11', such as by a torsion spring (not shown). Anyhow, it is to be provided that the locking arm 131' is capable of pivoting around the supporting portions 135' which act as fulcrums.

Figure 27:
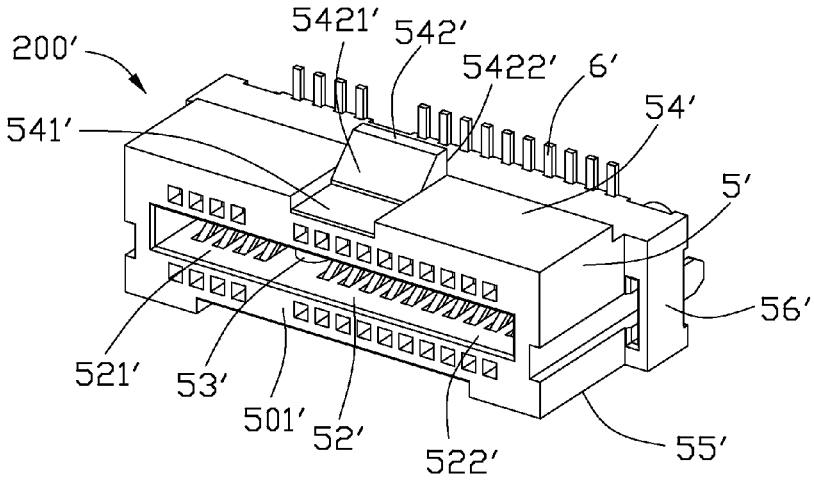
FIG. 27 is a perspective view of a receptacle connector in accordance with another illustrated embodiment.

Referring to FIG. 27, the receptacle connector 200' is compatible to USB 3.0 protocol and includes an insulative receptacle housing 5' and a plurality of contacts 6' received in the receptacle housing 5'. The receptacle housing 5' includes a mating face 501', a mounting face 502' opposite to the mating face 501', a receiving slot 52' recessed inwardly from the mating face 501', and a rib 53' inside the receiving slot 52' to divide the receiving slot 52' into a first slot 521' and a second slot 522'. The first and the second slots 521', 522' have different widths so that the cable connector 100' can be prevented from being reversely/incorrectly inserted into the receptacle connector 200'. The receptacle housing 5' includes a top wall 54', a bottom wall 55' and a pair of sidewardly extending blocks 56'. The receiving slot 52' is located between the top wall 54' and the bottom wall 55'. The top wall 54' includes a recess 541' extending through the mating face 501' and a protrusion 542' at the rear of the recess 541'. The protrusion 542' includes a slant guiding surface 5421' exposed to the recess 541' for guiding insertion of the locking arm 131' and a rear vertical surface 5422' for engaging with the hook 133'. According to the illustrated embodiment, the protrusion 542' is higher than the top wall 54' so as to form the rear vertical surface 5422' with a relative large area, which improves locking stability of the locking arm 131' and the rear vertical surface 5422'.

Figure 28:
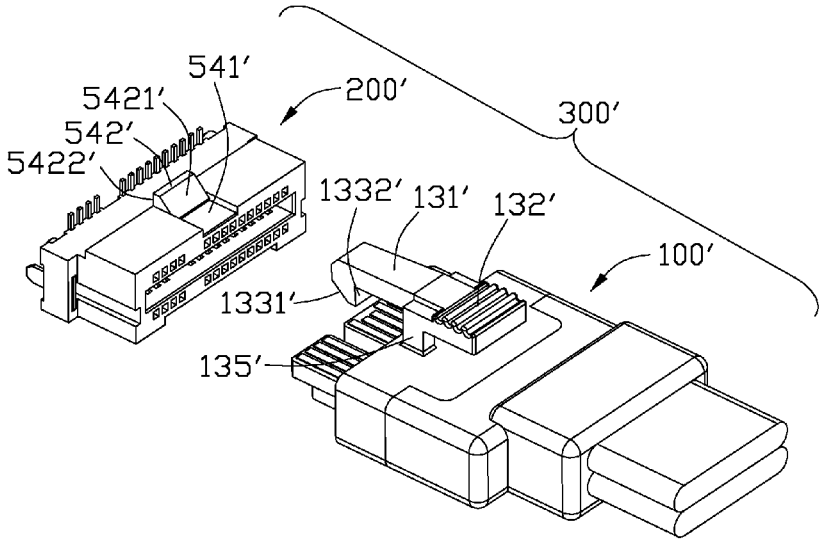
FIG. 28 is a perspective view of a connector assembly showing the cable connector separate from the receptacle connector in accordance with another embodiment.
Figure 29:
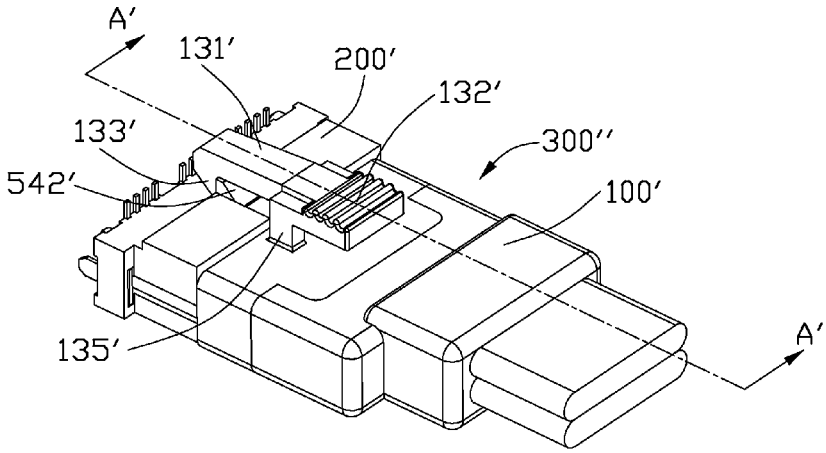
FIG. 29 is a perspective view of the connector assembly as shown in FIG. 28 with the cable connector inserted in the receptacle connector.
Figure 30:
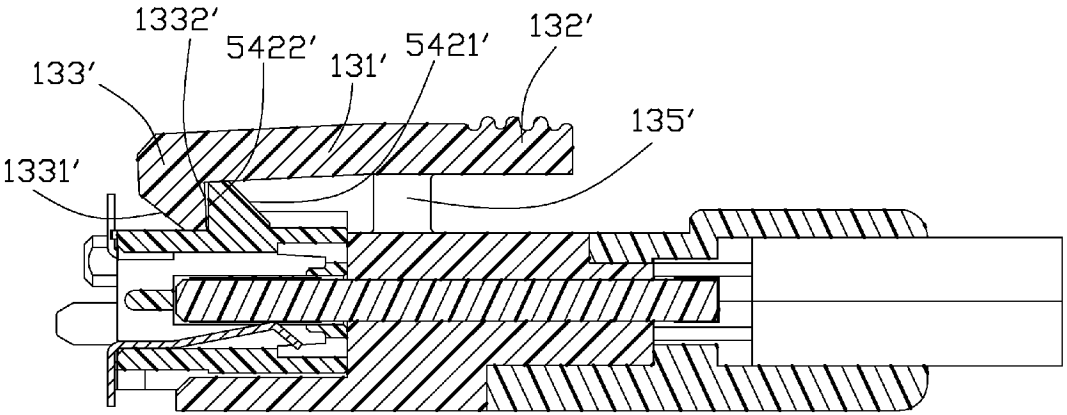
FIG. 30 is a cross-sectional view of the connector assembly taken along line A'-A' in FIG. 29.

Referring to FIGS. 28 to 30, when the cable connector 100' is inserted into the receptacle connector 200', the locking arm 131' is corresponding to the recess 541' and the slant surface 1331' of the hook 133' is guided by the slant guiding surface 5421' to climb. The locking arm 131' is driven to pivot upwardly to let the locking arm 131' ultimately get over the slant guiding surface 5421'. Once the locking arm 131' got over the slant guiding surface 5421', the locking arm 131' releases at least part of its elasticity to make the vertical surface 1332' of the hook 133' lock with the rear vertical surface 5422'. Under this condition, the cable connector 100' and the receptacle connector 200' are stably locked with each other.

When the plug connector 100' is needed to be separated from the receptacle connector 200', the pressing portion 132' may be downwardly pressed so as to uplift the locking arm 131'. Ultimately, the vertical surface 1332' of the hook 133' disengages with the rear vertical surface 5422' along the vertical direction and the plug connector 100' can be separated from the receptacle connector 200' when a pulling force along the front-to-back direction is applied.

FIGS. 31 to 34 further disclose another connector assembly 300" in accordance with another illustrated embodiment. The connector assembly 300" is also compatible to USB 3.0 protocol and includes a receptacle connector 200" for mounting to a circuit board 400" and a cable connector 100" for mating with the receptacle connector 200". It is mentioned that the same numeral of the connector assemblies 300, 300" in the two embodiments refer to the same component. Since the receptacle connector 200" and the cable connector 100" are similar to the receptacle connector 200 and the cable connector 100, respectively, same configurations thereof are omitted in description hereinafter.

The cable connector 100" is also compatible to USB 3.0 protocol and includes an insulative plug housing 1", a paddle PCB 2" retained in the plug housing 1" and a plurality of cables 3" for electrically connecting with the paddle PCB 2". The paddle PCB 2" includes a tongue plate 21" which defines a cutout 213" separating the tongue plate 21" into a first tongue 211" and a second tongue 212" of different widths. Besides, the insulative plug housing 1" includes a locking mechanism 13" formed on a first exterior wall 11" for locking with receptacle connector 200". The locking mechanism 13" includes a cantilevered locking arm 131" with a hook 133" towards the paddle PCB 2", a pressing portion 132" for receiving external pressing force and a fixed portion 134" between the hook 133" and the pressing portion 132" along a front-to-back direction. The fixed portion 134" is fastened to the first exterior wall 11". The locking arm 131" is swingable around the fixed portion 134" with respect to the first exterior wall 11".

Figure 31:
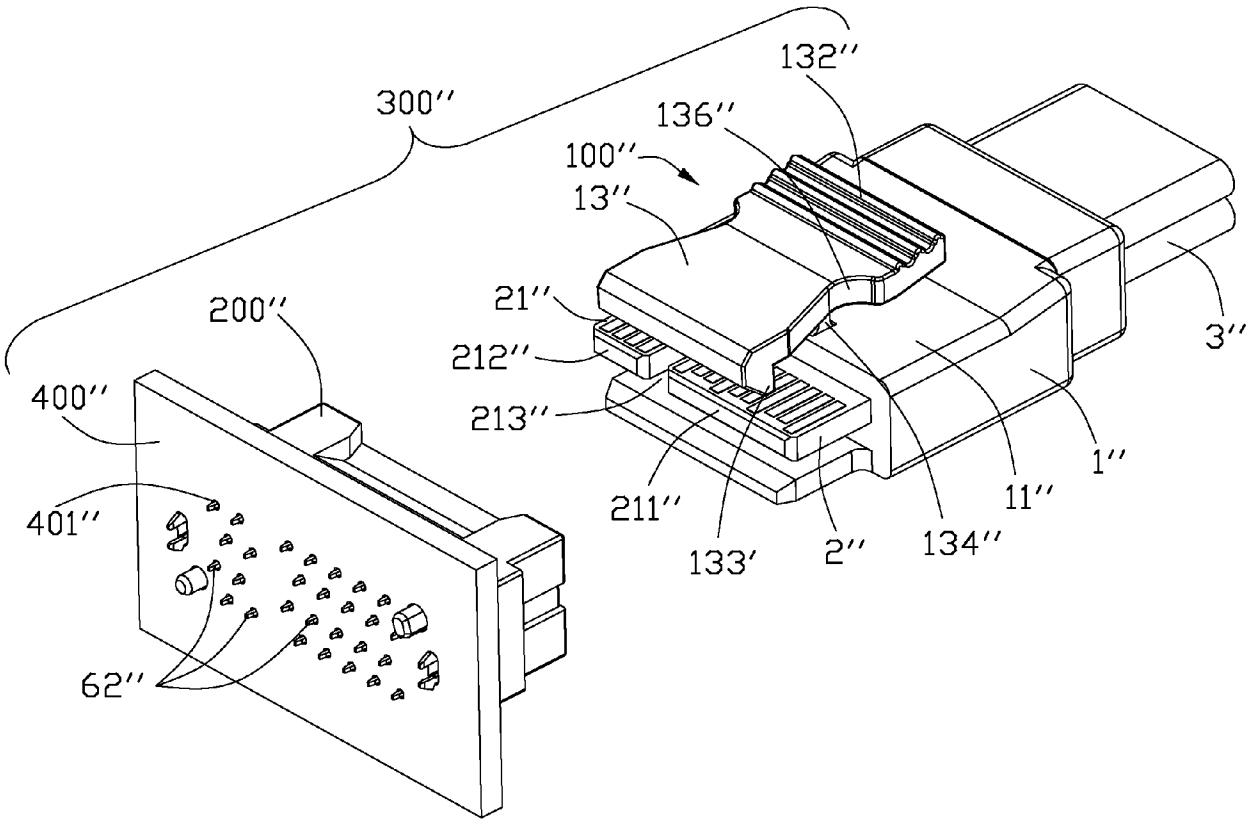
FIG. 31 is a perspective view of a connector assembly showing a cable connector separate from a receptacle connector in accordance with another embodiment.
Figure 33:
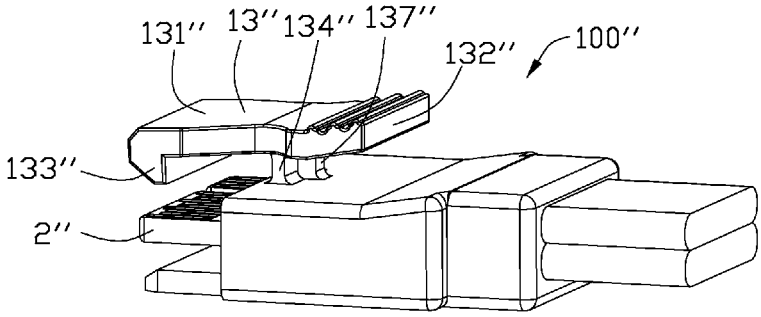
FIG. 33 is another perspective view of the cable connector.

The differences between the cable connector 100" and the cable connector 100 include different positions of the cutouts 213, 213" and different configurations of the locking mechanisms 13, 13". In detail, as shown in FIGS. 1 and 31, the second tongue 212 is wider than the first tongue 211 in the first embodiment while the second tongue 212" is narrower than the first tongue 211" in the third embodiment. Understandably, the first tongue 211" is the same as the second tongue 212 and the second tongue 212" is the same as the first tongue 211. The locking arm 131" is unitary without the slot 1313 as shown in FIG. 1. Besides, the locking arm 131" includes a contractive waist 136" between the hook 133" and the pressing portion 133" along the front-to-back direction. Furthermore, as shown in FIG. 33, in order to better support the locking mechanisms 13, a reinforce block 137" is formed integrally with the fixed portion 134". The reinforce block 137" protrudes backwardly beyond the fixed portion 134" along the front-to-back direction.

Figure 32:
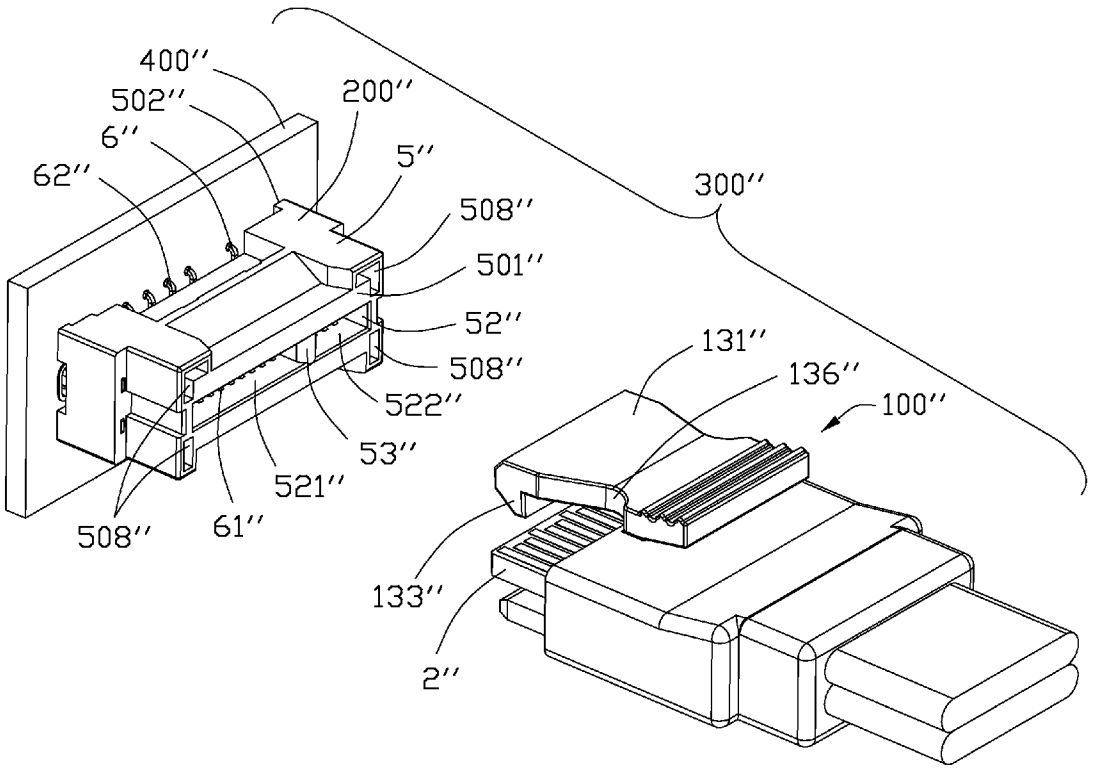
FIG. 32 is a perspective view of the connector assembly as shown in FIG. 31 while taken from a different aspect.

Referring to FIG. 32, the receptacle connector 200" is compatible to USB 3.0 protocol and includes an insulative receptacle housing 5" and a plurality of contacts 6" received in the receptacle housing 5". The receptacle housing 5" includes a mating face 501", a mounting face 502" opposite to the mating face 501", a receiving slot 52" recessed inwardly from the mating face 501", and a rib 53" dividing the receiving slot 52" into a first slot 521" and a second slot 522". The first and the second slots 521", 522" have different widths so that the cable connector 100" can be prevented from being reversely/incorrectly inserted into the receptacle connector 200". Each contact 6" includes an elastic contacting portion 61" protruding into the receiving slot 52" and a mounting portion 62" extending beyond the mounting face 502" of the receptacle housing 5".

The differences between the receptacle connector 200" and the receptacle connector 200 include different positions of the ribs 53, 53" and different mounting styles of the mounting portions 62, 62" etc. In detail, as shown in FIGS. 20 and 32, the second slot 522 is wider than the first slot 521 in the first embodiment while the second slot 522" is narrower than the first slot 521" in the third embodiment. Understandably, the first slot 521" is the same as the second slot 522 and the second slot 522" is the same as the first slot 521. Besides, the mounting portions 62" are inserted through mounting holes 401" of the circuit board 400" for soldering via Through Hole (TH) technology. Furthermore, each corner of the receptacle housing 5" defines an escaping hole 508" not only for material saving but also for stress releasing.

Figure 34:
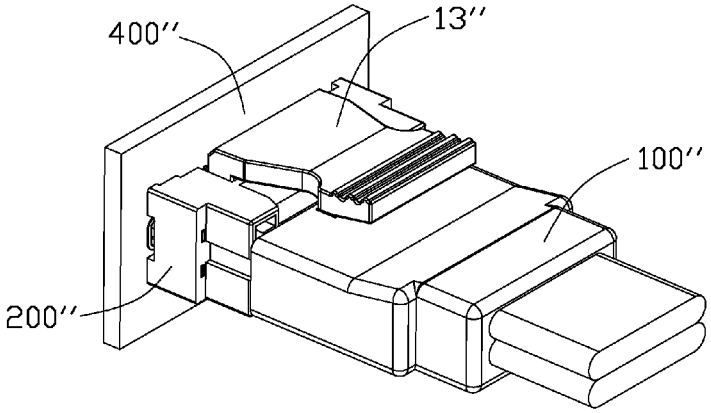
FIG. 34 is a perspective view of the connector assembly as shown in FIG. 31 with the cable connector inserted in the receptacle connector.

Referring to FIGS. 31, 32 and 34, similar to the working principles of the foregoing embodiments as shown in FIGS. 20 to 23, and 28 to 30, the cable connector 100" can be inserted into the receptacle connector 200" for locking, and the cable connector 100" can be separated from the receptacle connector 200" for disengaging. Repeated description is omitted herein.

It is to be understood, however, that even though numerous, characteristics and advantages of embodiments have been set forth in the foregoing description, together with details of the structure and function of the embodiments, the disclosed is illustrative only, and changes may be made in detail, especially in matters of number, shape, size, and arrangement of parts within the principles of the disclosure to the full extent indicated by the broadest general meaning of the terms in which the appended claims are expressed.

The various embodiments described above can be combined to provide further embodiments. Aspects of the embodiments can be modified, if necessary to employ concepts of the various patents, application and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A cable connector, comprising:

a plug housing defining a mating surface;

a paddle PCB retained in the plug housing and comprising a cantilevered tongue plate extending forwardly beyond the mating surface, the tongue plate being provided with a plurality of conductive pads on at least one side surface thereof; and cables electrically connected to the conductive pads of the paddle PCB, wherein the tongue plate comprises a first tongue and a second tongue adjacent to the first tongue;

the conductive pads comprise a plurality of first pads formed on the first tongue and a plurality of second pads formed on the second tongue, the second pads being compatible to USB 3.0 protocol;

the second pads comprise a plurality of differential signal pads and ground pads among which the differential signal pads are paired and the ground pads are located at opposite lateral sides of each paired differential signal pads, the first pads being arranged as GGVV, or VGVG, or VVGG, or GVGV, or GVVG, or VGGV, or VSSG, or GSSV;

the plug housing comprises a first exterior wall and a locking mechanism on the first exterior wall, the locking mechanism comprising a locking arm outside the tongue plate and a pressing portion for driving the locking arm so that the locking arm is swingable with respect to the first exterior wall, the locking arm extending forwardly beyond the mating surface and comprising a hook towards the tongue plate; and the plug housing comprises a second exterior wall opposite the first exterior wall, the second exterior wall comprising a flat position block cantileveredly extending forwardly beyond the mating surface with tongue plate located between the flat position block and the locking arm, the flat position block being parallel to the tongue plate.

2. The cable connector as claimed in claim 1 wherein the locking mechanism comprises a fixed portion between the hook and the pressing portion along a front-to-back direction, the fixed portion being fastened to the first exterior wall so that the locking arm is swingable around the fixed portion.

3. The cable connector as claimed in claim 2 wherein the fixed portion is integrally formed with the first exterior wall and the locking arm comprises a contractive waist between the hook and the pressing portion along the front-to-back direction.

4. The cable connector as claimed in claim 1 wherein the locking mechanism comprises a pair of supporting portions fixed to the first exterior wall, the pressing portion connects the supporting portions, and the locking arm is swingable with respect to the first exterior wall around the supporting portions which act as fulcrums.

5. The cable connector as claimed in claim 2 wherein the locking mechanism comprises a reinforce block integral with the fixed portion, the reinforce block protruding beyond the fixed portion along the front-to-back direction.

6. The cable connector as claimed in claim 1 wherein the locking arm comprises a first arm, a second arm and a slot separating the first and the second arms, the hook comprising a first hook formed on a distal end of the first arm and a second hook formed on a distal end of the second arm.

7. The cable connector as claimed in claim 1 wherein the first tongue and the second tongue are coplanar and are separated by a cutout therebetween, and the first tongue and the second tongue have different widths.

8. The cable connector as claimed in claim 1 wherein both opposite sides of the first tongue are set with the first pads and both opposite sides of the second tongue are set with the second pads, the second pads being arranged as GSSGSSGSSG in turn from left to right.

9. A connector assembly comprising:

a receptacle connector including:

a receptacle housing defining a mating face and a receiving slot recessed from the mating face; and a plurality of contacts received in the receptacle housing and each comprising an elastic contacting portion sidewardly extending into the receiving slot, wherein the contacts comprise a plurality of first contacts and a plurality of second contacts, the second contacts being compatible to USB 3.0 protocol and comprising a plurality of differential signal contacts and ground contacts among which the differential signal contacts are paired and the ground contacts are located at opposite lateral sides of each paired differential signal contacts, the first contacts being arranged as GGVV, or VGVG, or VVGG, or GVGV, or GVVG, or VGGV, or VSSG, or GSSV; and a cable connector including:

a plug housing defining a mating surface; and a paddle PCB fixed on the plug housing and comprising a cantilevered tongue plate extending forwardly beyond the mating surface, the tongue plate being provided with a plurality of conductive pads formed on at least one side surface thereof, wherein the conductive pads comprise a plurality of first pads and a plurality of second pads, the second pads being compatible to USB 3.0 protocol and comprising a plurality of differential signal pads and ground pads among which the differential signal pads are paired and the ground pads are located at opposite lateral sides of each paired differential signal pads, the first pads being arranged as GGVV, or VGVG, or VVGG, or GVGV, or GVVG, or VGGV, or VSSG, or GSSV, wherein when the cable connector and the receptacle connector are mated with each other, the tongue plate is received in the receiving slot and the elastic contacting portions of the first and the second contacts engage with corresponding first and second pads for signal transmission;

a bottom wall of the receptacle housing defines a position slot extending through the mating face, and the plug housing comprises a first exterior wall and a second exterior wall opposite the first exterior wall, the second exterior wall comprising a flat position block cantileveredly extending forwardly beyond the mating surface to be received in the position slot.

10. The connector assembly as claimed in claim 9 wherein the receptacle housing comprises a top wall with the receiving slot located between the top wall and the bottom wall, the top wall comprising a recess extending through the mating face and a protrusion which includes a guiding surface exposed to the recess and a rear vertical surface;

the plug housing comprises a locking mechanism on the first exterior wall, the locking mechanism comprising a locking arm outside the tongue plate and a pressing portion for driving the locking arm so that the locking arm is swingable with respect to the first exterior wall, the locking arm extending forwardly beyond the mating surface and comprising a hook towards the tongue plate; and when the cable connector and the receptacle connector are mated with each other the hook is guided along the recess and ultimately gets over the protrusion via deformation of the locking arm so as to engage with the rear vertical surface.

11. The connector assembly as claimed in claim 9 wherein the locking arm comprises a contractive waist between the hook and the pressing portion.

12. The connector assembly as claimed in claim 9 wherein the second pads are arranged as GSSGSSGSSG in turn, and the second contacts are arranged as GSSGSSGSSG in turn as well.

* * * * *